US008336645B2

(12) United States Patent
Robson et al.

(10) Patent No.: US 8,336,645 B2
(45) Date of Patent: Dec. 25, 2012

(54) DRILLING CUTTINGS MOBILIZER AND METHOD FOR USE

(75) Inventors: Daniel Robson, Okotoks (CA); Christopher Konschuh, Calgary (CA); Laurier Comeau, Leduc (CA); Paul Sibbald, Calgary (CA)

(73) Assignee: Arrival Oil Tools, Inc., Calgary, Alberta (CA)

( * ) Notice: Subject to any disclaimer, the term of this patent is extended or adjusted under 35 U.S.C. 154(b) by 356 days.

(21) Appl. No.: 12/550,192

(22) Filed: Aug. 28, 2009

(65) Prior Publication Data

US 2011/0048803 A1 Mar. 3, 2011

(51) Int. Cl.
*E21B 10/44* (2006.01)

(52) U.S. Cl. ..... 175/323; 175/324; 175/325.2; 175/325.5; 166/241.6

(58) Field of Classification Search ..... 175/231, 175/323, 324, 325.2–5; 166/241.6
See application file for complete search history.

(56) References Cited

U.S. PATENT DOCUMENTS

| | | | | |
|---|---|---|---|---|
| 2,794,617 | A * | 6/1957 | Yancey | 175/323 |
| 3,196,952 | A | 7/1965 | Solum | |
| 3,971,450 | A * | 7/1976 | Fox | 175/107 |
| 4,984,633 | A | 1/1991 | Langer et al. | |
| 5,040,620 | A | 8/1991 | Nunley | |
| 5,425,419 | A * | 6/1995 | Sieber | 166/206 |
| 6,056,073 | A | 5/2000 | Boulet | |
| 6,223,840 | B1 | 5/2001 | Swietlik | |
| 6,575,239 | B2 * | 6/2003 | Allen | 166/170 |
| 6,732,821 | B2 | 5/2004 | Boulet | |
| 7,182,160 | B2 | 2/2007 | Boulet | |
| 2002/0096368 | A1 | 7/2002 | Kirk et al. | |
| 2007/0056773 | A1 * | 3/2007 | Booth | 175/57 |

FOREIGN PATENT DOCUMENTS

| | | | |
|---|---|---|---|
| GB | 2334541 | | 8/1999 |
| GB | 2370297 | A * | 6/2002 |
| GB | 2411919 | | 9/2005 |
| GB | 2429723 | | 3/2007 |
| WO | 99/05391 | A1 | 2/1999 |
| WO | 0198621 | | 12/2001 |
| WO | 0235055 | | 5/2002 |

(Continued)

OTHER PUBLICATIONS

Weatherford; "Hydroclean® Drill Pipe" Informational Product Brochure No. 630.00; © 2003.

(Continued)

*Primary Examiner* — Giovanna Wright
*Assistant Examiner* — Ronald Runyan
(74) *Attorney, Agent, or Firm* — Wong, Cabello, Lutsch, Rutherford & Brucculeri, LLP

(57) ABSTRACT

A rotating drill string sub redistributes wellbore drill cuttings into the drilling fluid flowstream to improve the efficiency of the drilling operation. Standoff elements are located on each side of an agitator, all configured on a relatively short section of drill pipe. The agitator comprises a plurality of alternating blades standing radially outward from and arranged helically about the axis of the sub, and grooves located between pairs of adjacent blades, each groove comprising a flow channel that is open at both ends of the agitator. The standoff elements contain abutment surfaces having an outer diameter greater than the outer diameter of the agitator, so that the agitator is prevented from contacting the wall of the wellbore and therefore does not experience the forces that the standoff elements experience.

13 Claims, 8 Drawing Sheets

FOREIGN PATENT DOCUMENTS

| | | |
|---|---|---|
| WO | 2005093204 | 10/2005 |
| WO | 2009046077 | 4/2009 |
| WO | 2009095794 | 8/2009 |

OTHER PUBLICATIONS

Halliburton; "Cuttings Bed Impeller (CBI™);" Informational Product Brochure; © 2008.

VAM-Drilling; "Hydroclean™: Hydroclean—Reducing Non-Productive Time;" Informational Product Brochure.

Combined Great Britain Combined Search and Examination Report for GB Application No. 1012594.6, Oct. 7, 2010, 6 pages.

Combined Great Britain Combined Search and Examination Report for GB Application No. 1012594.6, Oct. 21, 2011, 7 pages.

* cited by examiner

DRILLING CUTTINGS MOBILIZER AND METHOD FOR USE

BACKGROUND

In industries that rely upon access to subsurface geological strata in order to produce commercial flow streams, such as oil and natural gas, wells are drilled from the surface down to a planned depth using an assembled string of steel tubular pipe having a drill bit attached to the bottom of the string. As the string is rotated at the surface by a power train, the bit crushes rock and forms a wellbore of a diameter roughly the same as the drill bit. The rock fragments produced by this process, or cuttings, are carried out of the way of the bit by flowing a constant stream of mud, typically down through the center of the string, exiting the string at the bit, and back up through the annulus formed between the wall of the wellbore and the outer surface of the drill string pipe. As the mud flows up through the annulus, the viscosity of the mud is sufficient to exert a vertical force on the cuttings that overcomes the weight of the cuttings, and in this way they are carried up to the surface for processing and disposal. As long as the drilling is at or near a vertical direction, the viscosity forces are most effective because the direction of the flow of the mud is directly or nearly directly opposite to the gravity forces on the cuttings.

In horizontal drilling, after some vertical depth is achieved, the drill bit is then directed to an angle at or near horizontal, and may continue in that trajectory for great distances. The flow of the mud inside the wellbore is parallel with the axis of the wellbore, which in this situation is at or near horizontal, so the cuttings are not only carried horizontally by the viscous force of the mud, but are also acted upon vertically downward by the pull of gravity. The viscous forces imparted by the mud when travelling horizontally often cannot overcome the gravity forces, thereby allowing the cuttings to congregate in higher densities along the low side of the horizontal wellbore.

This accumulation of cuttings poses various problems for the drilling process. The higher density of cuttings there increases drag on the drill string by causing contact and interference with the rotational as well as translational movement of the drill string pipe and other drill string components. The higher density of cuttings also increases the wear and tear on the drill string, as well as increases the likelihood of downhole problems such as stuck pipe. All of these situations reduce the productivity of the drilling operation.

The subject matter of the present disclosure is directed to overcoming, or at least reducing the effects of, one or more of the problems set forth above.

SUMMARY

A rotating drill string sub used during drilling operations is inserted into the drill string at various locations for the purpose of redistributing wellbore drill cuttings into the drilling fluid flowstream. The redistribution of the drill cuttings reduces the amount of cuttings that settle toward the low side of a horizontal wellbore. The drill string sub comprises an agitator and standoff element spaced on each side of the agitator, all configured on a section of drill pipe. The agitator comprises a plurality of alternating blades standing radially outward from the axis of the sub and arranged helically about the axis of the sub, and a plurality of alternative grooves, each groove located between a pair of adjacent blades and each comprising a flow channel that is open at both ends of said agitator. Each of the standoff elements contains abutment surfaces, wherein the abutment surfaces comprise an outer diameter that is greater than the outer diameter of the agitator, so that the agitator is prevented from contacting the wall of the wellbore.

BRIEF DESCRIPTION OF THE DRAWINGS

FIG. 1 illustrates the cuttings mobilizer sub 10 in the form of a drill string sub 10. All of the subcomponents share a common axis of rotation 7. The sub 10 has couplings 6*a* and 6*b* on each end, which are used to attach the sub to other elements of the drill string. The agitator 1 is located between standoff elements 2 and 3. Profile area 4 is located between the agitator 1 and the downhole standoff element 2. The direction of the drilling fluid flowstream, relative to the sub, is illustrated by arrows 62 and 63. The drill pipe 5 attaches all of the subcomponents together. The downhole and uphole directions are depicted by the arrows 60 and 61, respectively.

FIG. 2 illustrates some of the detail of the agitator 1. The grooves 12 are located between blades 11, all arranged helically around axis 7. The baseline of each groove is identified by the lines 15. The orientation of the agitator 1 is defined by the downhole direction arrow 60 (as is the case in FIGS. 3 and 4).

FIG. 3 illustrates the downhole standoff element 2. The grooves 22 are located between blades 21, all arranged helically around axis 7. The blades are tapered at each end, forming tapered surfaces 24 that lie at angle 26 with respect to a perpendicular to the axis 7. The base of the groove 22 has a width 53. Hardfacing layer 28, butter layer 29, and clusterite weld overlay 27 are also indicated.

FIG. 4 illustrates the uphole standoff element 3. The grooves 32 are located between blades 31. The blades are tapered at each end, forming tapered surfaces 34 that lie at angle 26 with respect to a perpendicular to the axis 7.

FIG. 5 illustrates a cross section of the downhole standoff element 2. The section includes the groove 22 and blade 21. The width 52 of the blade 21 is shown, along with the width 53 and depth 54 of the groove 22. The abutment surfaces 23 are located on the outer diameter 51 of the standoff element 2. Axis 7, which runs perpendicular to the section, is noted as a point located at the center of the section.

FIG. 6 illustrates a cross section of the agitator 1, showing grooves 12 located between blades 11 whose outer surfaces are located at the outer diameter 55. The leading face of each blade 11 is the face 13, which is oriented at an angle 14 with respect to a perpendicular to the axis 7. Axis 7, which runs perpendicular to the section, is noted as a point located at the center of the section. The direction of rotation of the agitator 1 is shown by the arrow 64.

FIG. 7 illustrates an elevation view of the cuttings mobilizer sub 10. The profile area 4 is shown, comprising length 41 where the diameter of the profile area is increasing in the direction 63 of drilling fluid flow, and length 42 over which the diameter of the profile area 4 is decreasing in the direction 63 of drilling fluid flow.

DETAILED DESCRIPTION

1. The System

The drill string system that is used to drill a wellbore is comprised of separate elements, or joints, that are coupled together. Most of the joints are basic drill pipe, or pipe segments typically of 30 ft. (approx. 9.1 m.), 45 ft. (approx. 13.7 m.), or 60 ft. (approx. 18.3 m.) length, that are coupled end to end and whose basic purpose is to advance the drill bit downward into the wellbore, to transmit the rotational torque that turns the drill bit, and to serve as a conduit for the drilling fluid, typically drilling mud or gas. Other elements of the string serve different specific purposes. The very end of the string is the drill bit. Other elements serve to keep the drill string centered in the wellbore. Some elements serve to afford contingency operations in a situation where the drill string gets stuck in the wellbore, meaning that the string cannot translate any further into or out of the hole or cannot rotate. A specialized element that serves a particular function is often much shorter than a typical joint, and is referred to as a sub. The present invention is packaged as its own separate sub 10.

Figure 1:
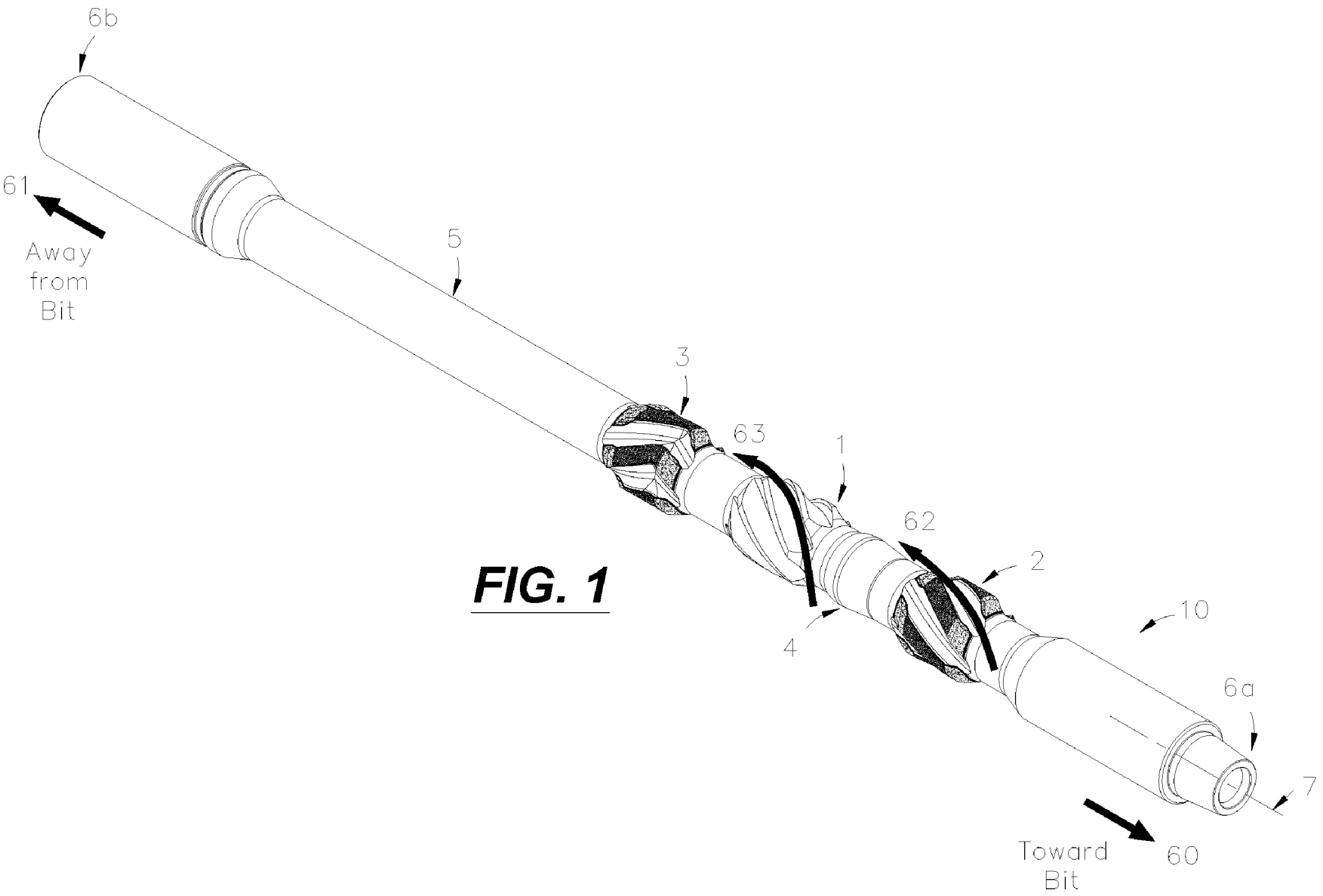
FIGS. 1 thru 7 illustrate the preferred embodiment of the cuttings mobilizer sub 10.

In describing various locations on the string, the term "downhole" 60 identified in FIG. 1 refers to the direction along the axis of the wellbore that looks toward the furthest extent of the wellbore. From any point on the drill string, downhole is also the direction toward the drill bit location. Likewise, the term "uphole" 61 refers to the direction along the axis of the wellbore that leads back to the surface, or away from the drill bit. In a situation where the drilling is more or less along a vertical path, downhole is truly in the down direction, and uphole is truly in the up direction. However, in horizontal drilling, the terms up and down are ambiguous, so the terms downhole 60 and uphole 61 are necessary to designate relative positions along the drill string. Similarly, in a wellbore approximating a horizontal direction, there is the "high" side of the wellbore and the "low" side of the wellbore, which refer, respectively, to those points on the circumference of the wellbore that are closest, and farthest, from the surface of the land or water.

FIG. 1 illustrates the present invention, the cuttings mobilizer sub 10. In the preferred embodiment of the invention, the cuttings mobilizer sub 10 comprises a single drill string sub, with standard couplings 6*a* and 6*b* at each end of the sub. Because the single sub 10 fully contains the invention rather than be integrated into a joint that comprises other functions, it is a tool that can be independently wielded to have greatest effect. In other words, the mobilizer sub 10 can be inserted at any location within the drill string, and in as many different locations, as is deemed necessary to meet the goals of the drilling operation (i.e., multiple cuttings mobilizer subs can be used simultaneously in the drill string), without the burden of having to synergize its functionality with that of another integrated apparatus. In addition, the fact that no other functions are embedded into the cuttings mobilizer sub aids in keeping the cuttings mobilizer sub 10 relatively short, which in turn makes it easier to handle and cheaper to manufacture.

There are three primary elements to the cuttings mobilizer sub 10, all shown in FIG. 1: the agitator 1, the uphole standoff element 2, and the downhole standoff element 3. All three elements are joined together on a conventional drill pipe 5 or any other type of drill pipe. The agitator 1 is situated between the two standoff elements 2 and 3. In the preferred embodiment, there is also profiled area 4 of the drill pipe 5 located downhole of the agitator 1.

2. Standoff Elements

The two standoff elements 2 and 3 are similar in configuration to that of typical stabilizers used in the industry; however, they act in concert to provide a function that is different from that of the typical stabilizers used in the industry. In the typical stabilizer application, the outer diameter of the stabilizer is very near that of the drill bit diameter, and as a result the stabilizers will contact or nearly contact the wall of the wellbore at all times. At various phases of the drilling operation, inserting stabilizers into the drill string can achieve either of two things: they can keep the advancement of the drill bit proceeding in a straight line, and therefore prevent any further curvature of the wellbore trajectory until the drill string is reconfigured, or they can influence the drill bit in such a way that the forward translation of the drill bit is biased toward a particular direction, thereby achieving a certain desired curvature in the trajectory of the wellbore. The end result of the action of the typical stabilizer sub or stabilizer joint depends on the relative distance in the joint between the stabilizer elements, the location of the joint(s) within the drill string, and the relative stiffness of the pipe member to which individual stabilizer elements are attached. Thus typical stabilizers either prevent curvature of the wellbore trajectory, or they cause curvature, but in either case the stabilizer elements are in substantial contact with the wall of the wellbore. To serve these functions, the stabilizers must necessarily be of highly robust design and construction in order to withstand the extremely high loads that are imparted to the stabilizers when they experience contact with the wall of the wellbore.

In the present invention, the role of the standoff elements 2 and 3 is different from typical stabilizers. The standoff elements 2 and 3 would be ineffective to steer the trajectory of the wellbore. This is because whereas the typical stabilizer has an outer diameter that is very nearly equal to the diameter of the wellbore, the diameter 51 (FIG. 5) of the standoff elements 2 and 3 in the present invention are not nearly as close to that of the drill bit. For example, for a 7" (approx. 17.8 cm.) diameter bit, the diameter of the standoff elements 2 and 3 might be approximately 5⅛" (approx. 13.0 cm.), whereas the typical industry stabilizer would be 6⅞" (approx. 17.5 cm.). However, that does not mean that the standoff elements 2 and 3 will never contact the wellbore wall. In fact, it is expected from time to time that they will contact either the wall of the wellbore are at least small localized upsets in the wall of the wellbore. More specifically, as an example, if the cutting mobilizer sub 10 has several joints of standard drilling pipe both downhole and uphole from it, in a horizontal section of wellbore, then a natural sag in the drill string would result from the flexibility in the drill string yielding to a transverse pull of gravity; then, the cuttings mobilizer would almost certainly come into contact with the wall of the wellbore, and would do so at the low side of the wellbore where cuttings density is highest. In that situation, the sole purpose of the standoff elements 2 and 3 is to ensure that the agitator 1 does not also contact the wellbore wall or upsets therein. This is ensured by the relative proximity of the agitator 1 to the standoff elements 2 and 3 and the smaller diameter 55 (FIG. 6) of the agitator 1 as compared to the diameter 51 (FIG. 5) of the standoff elements.

Figure 3:
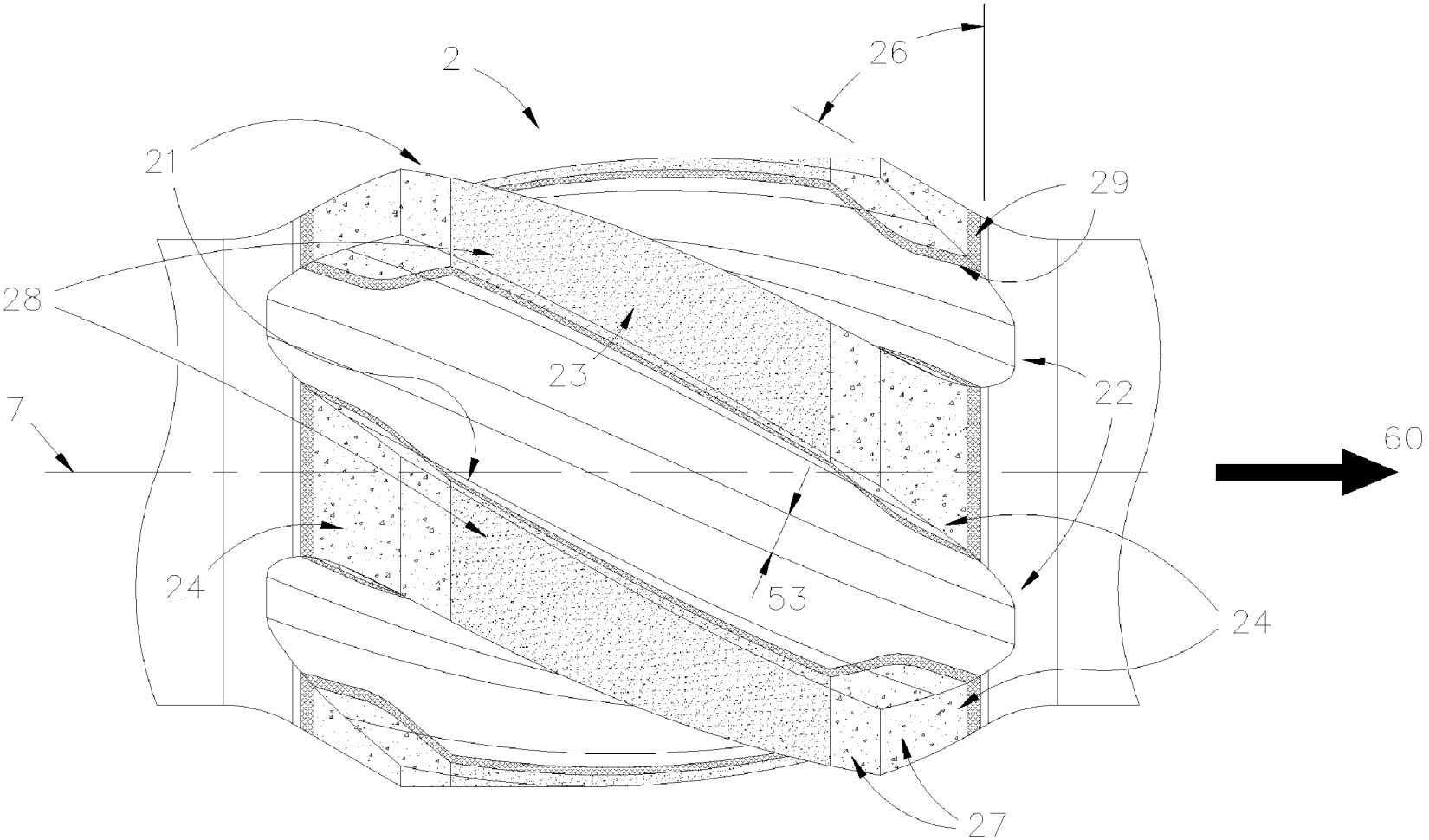
Figure 4:
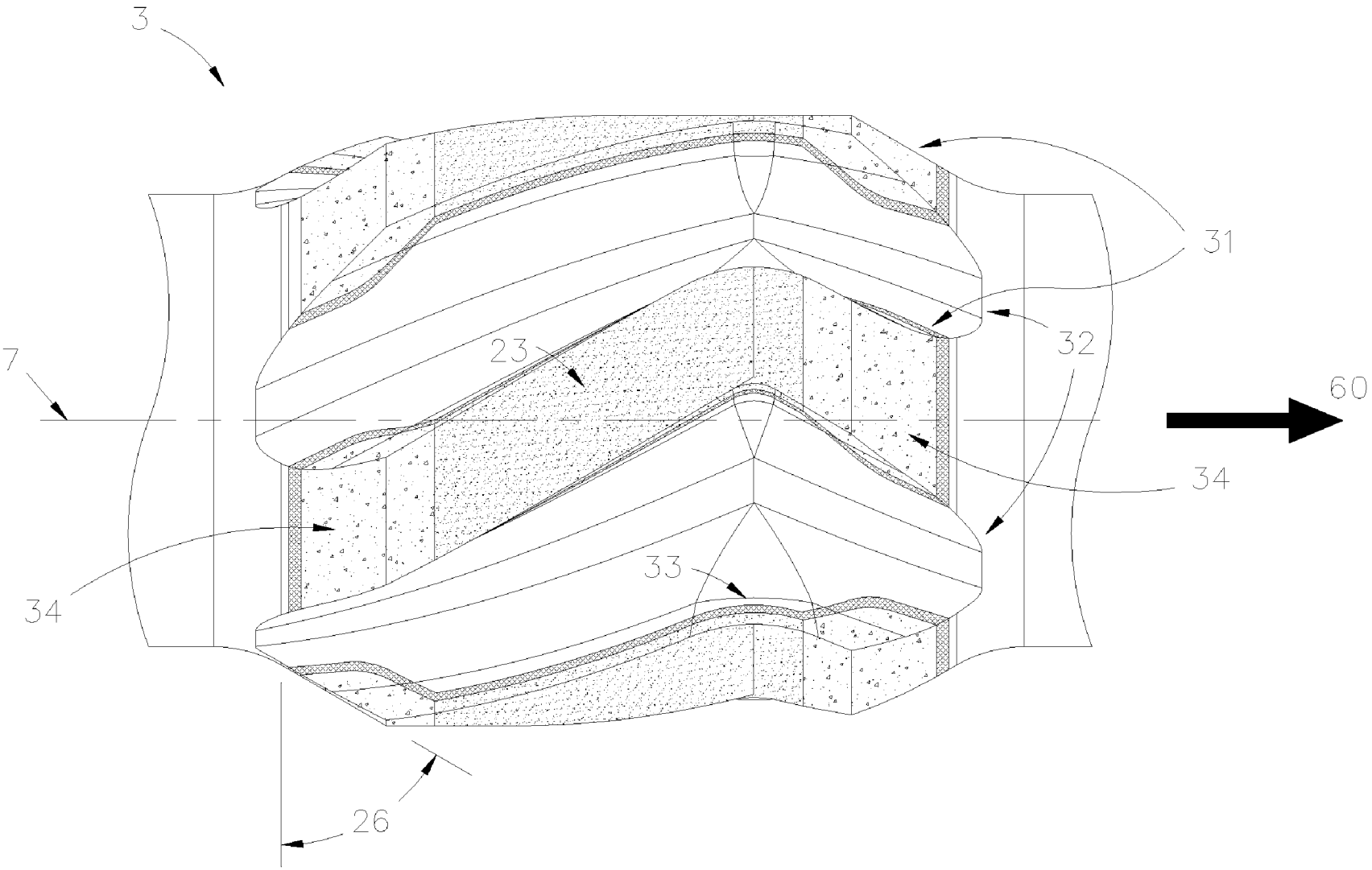
Figure 5:
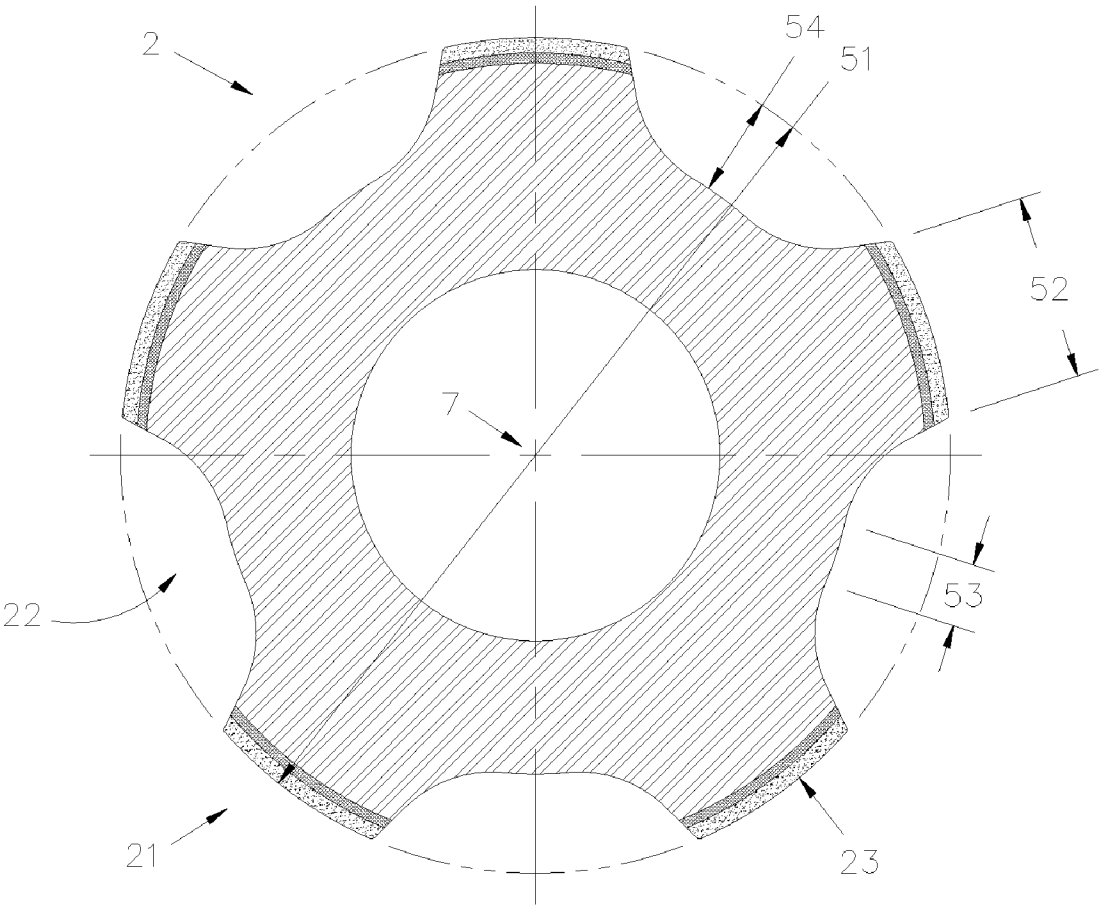

Referring to FIGS. 3 and 4, both standoff elements 2 and 3 are comprised of integral blades 21 and 31, respectively, which stand between the machined grooves 22 and 32, respectively. The blades and grooves are fashioned in a helical pattern around the circumference of the sub 10. Each blade is comprised of an abutment surface 23, which is capable of withstanding contact with the wall of the wellbore when necessary. The abutment surface 23 represents the outermost diameter of each standoff element, as measured radially from the central axis 7 of the sub 10, as shown in FIG. 5. All points located on the abutment surface 23 along the entire length of the blade lie on the same diameter 51 about the central axis 7. Accordingly, the abutment surface is not flat; rather it presents an arc shape as depicted in FIG. 5. The width 52 of the abutment surface of blades 21 or 31, which is the distance from a point on one edge of the abutment surface to the closest corresponding point on the opposite edge of the abutment surface, is constant along the entire length of the blades 21 or 31. The one exception to this geometrical preferred configuration is that uphole and downhole ends of each blade are not blunt; rather the blade is tapered at both ends, such that there are tapered faces 24 and 34 of the blade that is formed at some angle 26 as measured from a perpendicular to axis 7, as shown in FIG. 3. All points on all tapered faces 24 and 34 at any one end of the standoff element 2 or 3 can be said to lie on the same imaginary conical-shaped figure. Alternatively, the angle 26 could be eliminated, in which case the ends of each blade would be blunt surfaces, not tapered. On the downhole standoff element 2, all blades 21 are identical in shape and size, and all grooves 22 are identical in shape and size. Likewise, on the uphole standoff element 3, all blades 31 are identical in shape and size, and all grooves 32 are identical in shape and size. In the preferred embodiment, the blades 21 of standoff element 2 have the same width and height as the blades 31 of standoff element 3, and likewise for the grooves of the two standoff elements.

Figure 5B:
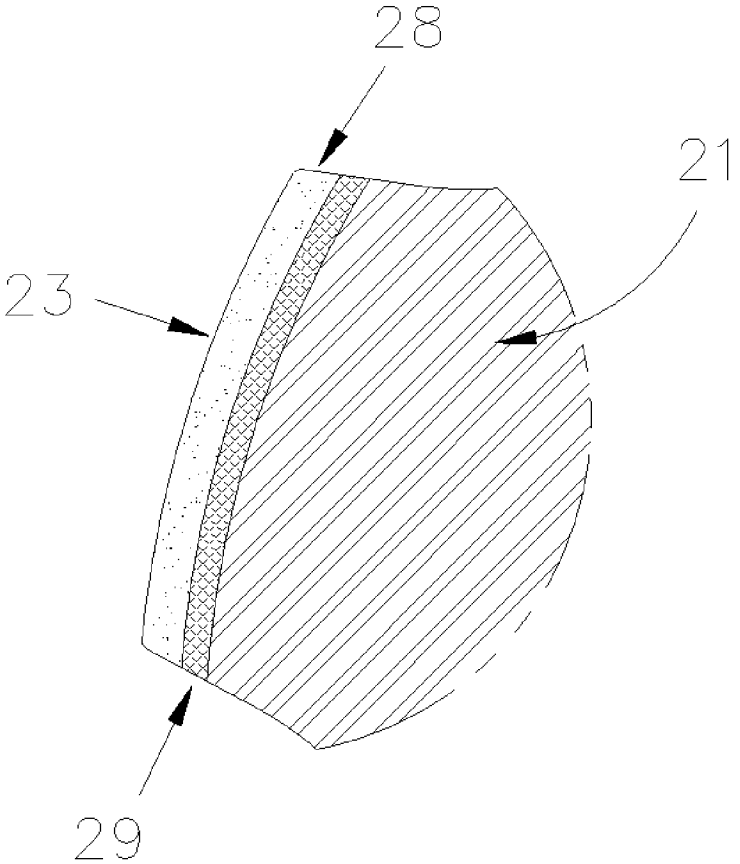
FIG. 5*b* illustrates a closeup of the blade 21 with abutment surface 23. The outer two material layers of the blade 21 are the hardfacing layer 28 and the butter layer 29, respectively.

The blades 21 and 31 comprise different materials. In FIGS. 3 and 4, at each end of each blade is a clusterite weld overlay 27, which serves as the "cutting edge" of the blade when contact is made with the wall of the wellbore, and must tolerate the associated loads imparted during any encounter with the wall of the wellbore. Between clusterite weld overlays 27, the abutment surface comprises an outer hardfacing layer 28. The butter layer 29 bridges the gap between the base metal of the blades 21 and 31 and the hardfacing layer 28, and lends flexibility in the design and manufacturing of the standoff elements 2 and 3. A cross section of some of these materials is shown in FIG. 5*b*.

In FIGS. 3 and 4, between each adjacent pair of blades 21 and 32 lies a groove 22 and 32, respectively. Just as the width and profile of all blades are constant along the length of the standoff element 2, so too is the width and profile of all grooves constant along the length of the standoff element 2. This is also true for the blades 31 and grooves 32 of the uphole standoff element, with the exception of the transition area which is described below. The widths and heights of the blades and grooves are depicted in FIG. 5. The overall effect of the alternating grooves of constant profile and blades of constant profile is to create a series of alternating and continuous flowpaths and alternating continuous abutment surfaces. During the drilling operation, mud and entrained cuttings will be allowed to flow freely through these continuous flow paths, as designated by arrow 62 in FIG. 1.

In the preferred embodiment, the uphole standoff element 3 is different in one respect from the downhole standoff element 2. The downhole standoff element 2 has what is known in the industry as a conventional "right-hand wrap" configuration, meaning that from a viewpoint looking downhole, the orientation of the helical pattern in the blades about the axis of rotation is clockwise, and can be described as having a "right-hand" convention, as that convention is often used in the industry to define an analogous torque application. This orientation is consistent also with the direction of rotation of the drill string. Conversely, a "left-hand wrap" standoff element would show a bias of curvature in the opposite direction. In the preferred embodiment, the uphole standoff element blades 31 are a combination of left- and right-hand helical orientation, illustrated in FIG. 4. The downhole end of standoff element 3 shows a right-hand orientation, just as the downhole standoff element 2 does. It is the uphole end of standoff element 3 that has a left-hand orientation because its functionality is intended to accommodate an uphole translation of the drill string (while the right-hand orientation accommodates downhole movement).

A typical application of the left-hand orientation of the blades 32 is an operation known in the industry as back-reaming, which is used in a situation where the drill string has become stuck somewhere in the wellbore. In this operation, while the drill string is still being rotated to the right, the drill string is lifted out of the hole for a short distance in order to "un-stick" the drill string. In this situation, it is useful for the uphole standoff element blades 31, should they come into contact with the wellbore wall, to be capable of dislodging or breaking small upsets in the wall of the wellbore. The left-hand helical orientation of the blades 31 allows the uphole standoff element 3 to perform more effectively in this manner.

As illustrated in FIG. 4, there is a transition zone 33 where the right- and left-hand orientations of the blades meet. Other than this transition zone, the profiles of the blades 31 and grooves 32 are the same as that of the downhole standoff element blades 21 and grooves 22.

3. Agitator

Figure 2:
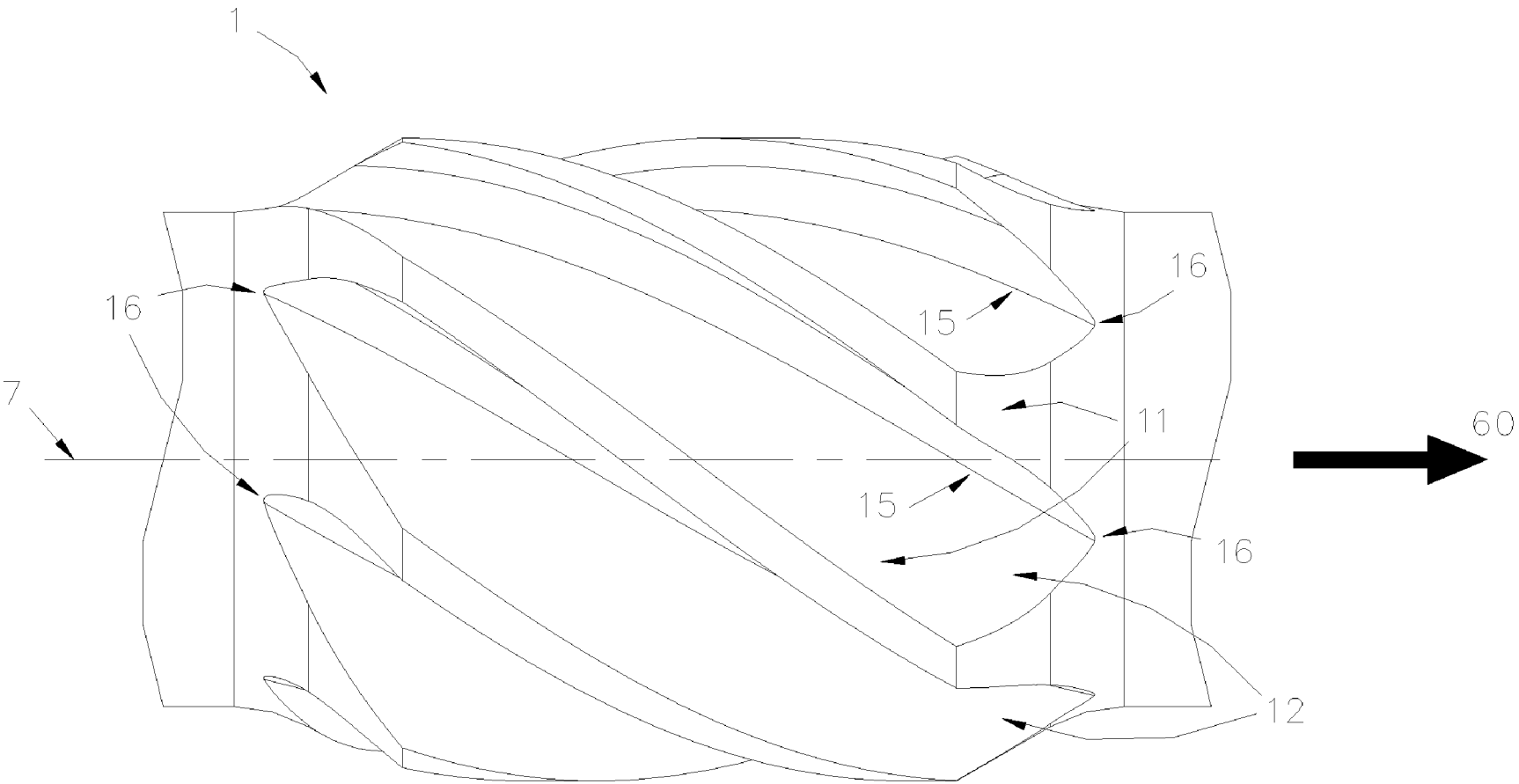
Figure 6:
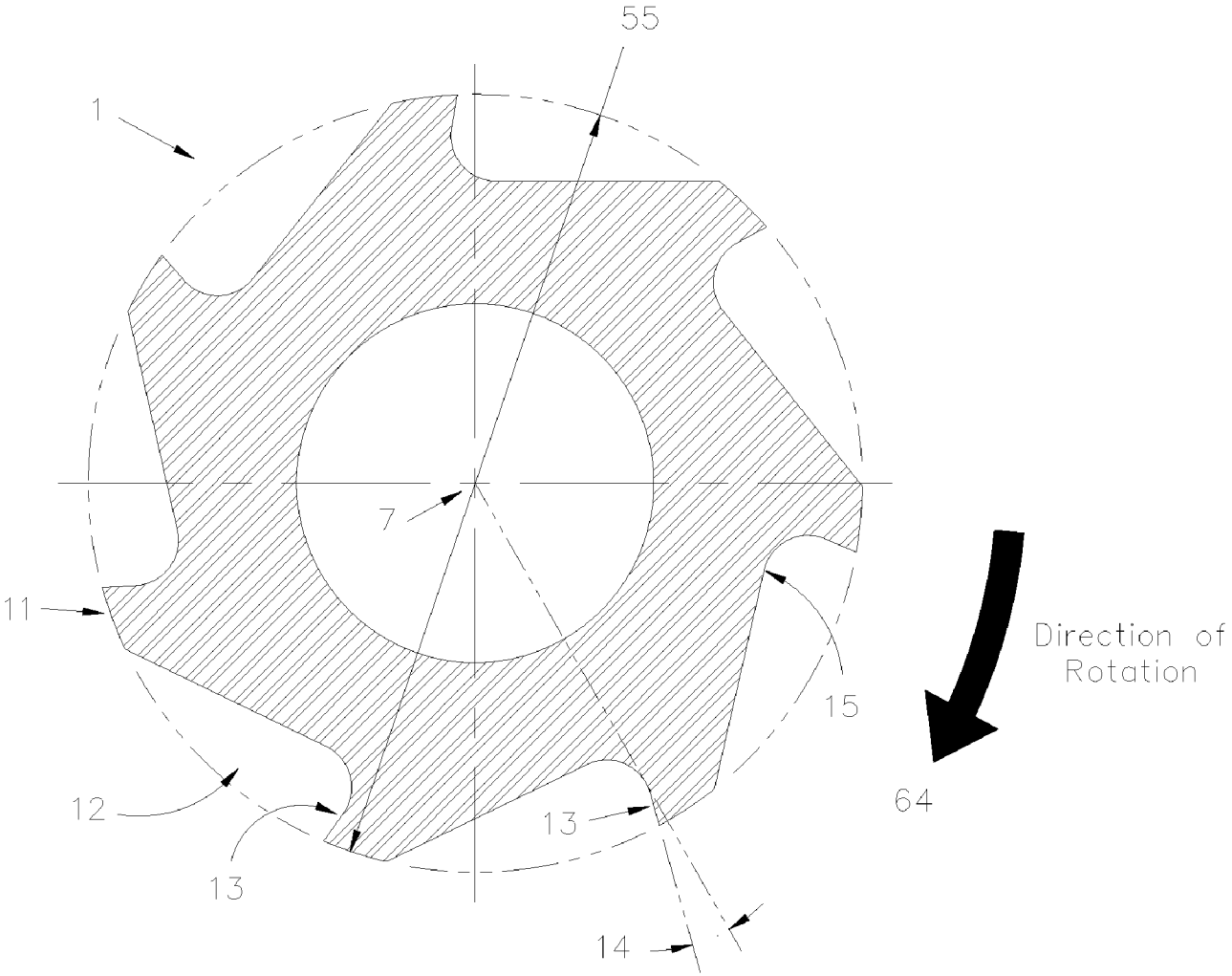

The agitator 1 is located between the standoff elements 2 and 3, as shown in FIG. 1. In FIGS. 2 and 6, the agitator 1 consists of blades 11, which stand outwardly in the radial direction from the axis 7 and are arranged helically around the drill pipe in the axial direction of the drill pipe. Between each pair of adjacent blades 11 is a groove 12, whose profile shape is defined by the faces of the adjacent blades 11. At the bottom of each groove 12 is the groove base 15, which at every section of the agitator 1 transverse to axis 7 contains the point on the groove that is radially closest to the axis 7 of the sub. In the preferred embodiment, the groove base 15 is represented by a single line; alternatively, the groove base 15 could have a defined width, similar to the grooves of the standoff elements 2 and 3 shown in FIG. 5, in which case at each transverse section of the agitator 1 the groove base 15 would be represented by a short arc, rather than a single point. Also in the preferred embodiment, every point on the groove base 15 lies at the same radial distance from the axis 7, which is necessary if all of the blades 11 have identical shape.

The entire groove 12 forms a flow channel for the drilling fluid, demonstrated by the arrow 63 in FIG. 1. More specifically, the flow channel is "open," defined herein as the condition where the radial distance of all points on the groove base as measured from the axis 7 does not increase at the outer edges 16 of the groove, and as a result the surrounding fluid can enter and exit the flow channel without having to move toward the axis 7, and therefore the fluid is unencumbered from entering and exiting the channel. "Substantially open" reflects the case where the points on the groove base at either end of the groove increase in radial distance away from axis 7 by a relatively slight amount. In the preferred embodiment, the grooves 12 of the agitator 1 are open at both ends. This open flow channel enhances the efficiency of the agitator in capturing the cuttings that tend to settle toward the low side of the wellbore and moving them toward the high side of the wellbore by means of the augering effect. In the preferred embodiment, the flow channels of the agitator 1 are open at both ends, but alternatively could be substantially open at one or both ends.

Likewise, referring back to the description of the standoff elements 2 and 3 above, the flow channels defined by the grooves 22 and 32, respectively, are also open at both ends in the preferred embodiment.

Because the standoff elements are capable of withstanding the relatively high impact loads that result from contact with the wellbore wall, they are able to keep the agitator 1, which is of a smaller outer diameter than that of the standoff elements 2 and 3, from having any contact with the wall of the wellbore. Because of this separation of duties, the agitator 1 design and construction have no need for the same level of strength and durability that the standoff elements 2 and 3 must have. Freed of the burden of having to withstand high loads, the design of the agitator 1 can be surgically suited to its sole purpose, which is to mobilize the cuttings that build up on the low side of the wellbore so that the cuttings can be swept into the flowstream of the mud and carried up to the surface, leaving behind a cleaner wellbore that presents less drag on the drill string.

Specifically, the blades 11 of the agitator 1, as compared to the blades of the standoff elements 2 and 3, have a sharper pitch in the curvature of the blade, are more densely arranged and thus there are more of them, and have a more aggressive profile (described below). The pitch of the helical curves of the blades 11 is essentially the ratio of the circumferential displacement of the blade relative to the axial displacement of the blade across a given axial length of the agitator 1, just as pitch is defined for any conventional screw. The differences between the blade profiles are illustrated in the comparison of FIG. 6, showing the profile of the agitator blades 11, with FIG. 5, showing the profile of the standoff element blades 21, as well as in FIG. 7, where the difference in pitch is evident.

Referring to FIGS. 2 and 6, the profile of the blades 11 of the agitator 1 is consistent throughout the length of the agitator. Likewise, the profile of the grooves 12 laying between the blades 11 of the agitator 1 is also consistent throughout the length of the agitator. The shape of the agitator blades 11 features a forward bias, such that the leading face 13 of the blade 11 that first contacts the drilling fluid while the drill string is rotating is undercut relative to an imaginary line drawn radially from the axis 7 of the sub 10. This undercut can be quantified by the angle 14 (FIG. 6), which is the degree to which the face of the blades 11 lays forward of said imaginary radial line. Thus, the agitator blade face 13 "leans" into the fluid. This forward bias, along with the sharper pitch of the helical curve of the blades 11, produces a greater augering effect in the agitator's influence upon the drilling fluid and the entrained cuttings. Thus, the blades 11 of the agitator 1 are not just stirring the cuttings within the flowstream of the mud, but are actually moving the cuttings from low side of the wellbore where their density is at a maximum, and redistributing them to areas in the wellbore where the density of cuttings is lower. This redistribution of cuttings achieves the benefits that the cuttings mobilizer is intended to achieve.

4. Profile Area

Figure 7:
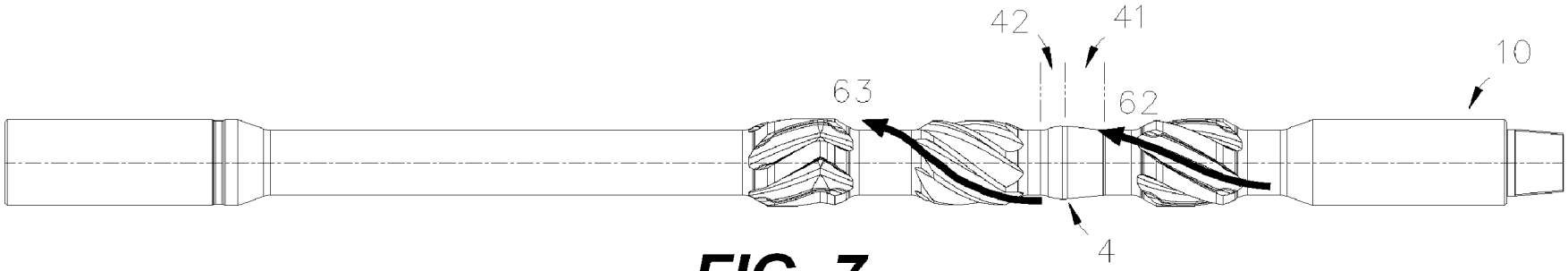

In the preferred embodiment, a profile area 4 is featured on that part of the drill pipe between the downhole standoff element 2 and the agitator 1, as shown in FIG. 1. As shown in FIG. 7, the profile area is an enlargement of the diameter of the drill pipe that linearly increases for some length 41 in the uphole direction, which is the direction of the mud flow relative to the sub 10. Where the increasing diameter reaches its extremity, the profile area then transitions across a length 42 whereby the diameter of the drill pipe decreases back to its original diameter. In the preferred embodiment, the length 41 is longer than the length 42, giving rise to a downhole portion of the profile area 4, coincident with length 41, that presents a more gradual change in pipe diameter than that of the uphole portion of the profile area 4, which is coincident with length 42. The result is an upset in the pipe diameter which will cause the velocity of the mud to increase as it flows past the profile area. The flow of the mud will also be directed toward the wall of the wellbore. At the low side of the wellbore, this means that the mud flow is being directed toward the area of cuttings settlement. This will tend to produce a scouring effect in this area, as well as create more turbulence on the uphole side of the profile area. The profile area 4 is purposely positioned downhole of the agitator 1 with the intent that this scouring and turbulence will enhance the action of the agitator 1.

5. Operation of the Cuttings Mobilizer

During drilling operations, the sub 10, or multiple subs 10, are inserted into the drill string at one or various locations. In the hole, the sub 10 rotates with the drill string about the axis 7 while translating in the downhole direction 60. Because of the relative diameters and their distances from each other, at all times the presence of the standoff elements 2 and 3 ensures that the outer surfaces of the agitator 1 do not contact the wall of the wellbore or any local upset in the wall of the wellbore. Whenever necessary, the abutment surfaces 23 of the standoff elements 2 and 3 make contact with the wall of the wellbore and allow the agitator 1 to "stand off" some small distance from the wall of the wellbore. The standoff elements 2 and 3 allow drilling fluid to flow freely through the open flow channels defined by the grooves 22 and 32. This drilling fluid will have drilling cuttings entrained in the flowstream.

Because the diameter of the standoff elements 2 and 3 is smaller than that of the typical stabilizer used in the industry, some high-density cuttings will remain near the wellbore, in the annular space between the outer diameter of the standoff elements 2 and 3 and the wall of the wellbore. In a horizontal wellbore, the drill string will encounter a higher density of cuttings at the low side of the wellbore. As the drill string translates downhole, drilling fluid will flow past the profile area 4 and increase in velocity as it does so, creating both bearing pressure and turbulence against the wall of the wellbore. At the low side of the wellbore, this pressure and turbulence is directed toward the highest concentration of cuttings, and creates an increase stirring or scouring effect upon those cuttings. This action enhances the ability of the blades 11 of the agitator 1 to scoop the cuttings into the flow channels of the agitator. The forward surface of the blades 11, in tandem with the relatively high pitch of the helical curve of the agitator, provide a significant augering effect upon the drilling fluid and the entrained cuttings, and moves cuttings from the high concentration area to an area of lower concentration.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A rotating drill string sub to redistribute wellbore drill cuttings into the drilling fluid flowstream, comprising:

an agitator, having a plurality of alternating blades standing radially outward from the axis of said sub and arranged helically about the axis of said sub, and having a plurality of alternating grooves, each groove located between a pair of adjacent said blades, and each groove comprising a flow channel that is open at both ends of said agitator;

at least two standoff elements each containing abutment surfaces, one standoff element spaced on each side of said agitator, and each standoff element connected to said agitator by a section of drill pipe, each standoff element comprising:

alternating blades standing radially outward from the axis of the sub, arranged helically about the axis of the sub, wherein the outer diameter of each of two said standoff elements is greater than the outer diameter of said agitator and prevents said agitator from contacting the wellbore, wherein at least a portion of each of the blades of a standoff element is arranged in a left-hand wrap orientation, wherein at least a portion of each of the blades of another standoff element is arranged in a right-hand wrap orientation, and wherein the helical blades in at least one of the at least two standoff elements are arranged such that at one end of said blades, said blades are arranged in a left-hand wrap orientation, while at the other end of said blades, said blades are arranged in a right-hand wrap orientation.

2. A rotating drill string sub according to claim 1, wherein said flow channels of said agitator are substantially open at both ends of said blades.

3. A rotating drill string sub according to claim 1, wherein each blade of said standoff elements contains an abutment surface.

4. A rotating drill string sub according to claim 3, wherein alternating open flow channels are located between each pair of adjacent blades of said standoff elements.

5. A rotating drill string sub according to claim 1, wherein said abutment surfaces further comprise an outer layer of hardfacing material.

6. A rotating drill string sub according to claim 1, wherein said abutment surfaces further comprise a clusterite weld overlay.

7. A rotating drill string sub according to claim 1, wherein said drill string sub comprises a profile area about said axis of drill string.

8. A rotating drill string sub according to claim 1, wherein said blades of said agitator comprise a leading face that is oriented in a forward bias relative to the direction that is radial from said axis of sub.

9. A rotating drill string sub to redistribute wellbore drill cuttings into the drilling fluid flowstream, comprising:

an agitator, having a plurality of alternating blades standing radially outward from the axis of said sub and arranged helically about the axis of said sub, and having a plurality of alternating grooves, each groove located between a pair of adjacent said blades, and each groove comprising a flow channel that is open at both ends of said agitator;

at least two standoff elements each containing abutment surfaces, one standoff element spaced on each side of said agitator, and each standoff element connected to said agitator by a section of drill pipe, each standoff element comprising:

alternating blades standing radially outward from the axis of the sub, arranged helically about the axis of the sub, wherein the outer diameter of each of two said standoff elements is greater than the outer diameter of said agitator and prevents said agitator from contacting the wellbore, wherein said helical blades of said standoff elements are arranged in a right-hand wrap orientation in one of the at least two standoff elements, and are arranged in a left-hand wrap orientation in another of said standoff elements.

10. A rotating drill string sub to redistribute wellbore drill cuttings into the drilling fluid flowstream, having end couplings that affix said sub to other joints of said drill string and rotates with said drill string, comprising:

a drilling fluid agitator that is fixed to said sub, comprising:

a plurality of alternating blades having a curvature about the axis of said drill pipe, wherein each blade has a concave face looking toward the direction of rotation;

a plurality of alternating grooves, each groove located between a pair of adjacent said blades, and each comprising a flow channel that is open at both ends of said agitator;

a downhole standoff element that is fixed to said sub, having a plurality of alternating downhole standoff element blades, wherein each said blade comprises:

an abutment surface located at the outer diameter of each blade of said downhole standoff element all of said downhole standoff element blades having a curvature about said axis of sub; and a plurality of alternating grooves, wherein each said groove is located between two adjacent downhole standoff element blades, and having the same curvature about said axis of sub as said adjacent downhole standoff element blades, wherein the arrangement of said downhole standoff element blades and grooves about said axis of sub forms alternating helical flowpaths and alternating helical abutment surfaces;

an uphole standoff element that is fixed to said drill pipe, having a plurality of alternating uphole standoff element blades, wherein each said blade comprises:

an abutment surface located at the outer diameter of each blade of said uphole standoff element, all of said uphole standoff element blades having a curvature about said axis of sub;

a plurality of alternating grooves, wherein each said groove is located between two adjacent uphole standoff element blades, and having the same curvature about said axis of sub as said adjacent uphole standoff element blades, wherein the arrangement of said uphole standoff element blades and grooves about said axis of sub forms alternating helical flowpaths and alternating helical abutment surfaces, wherein at least a portion of each of the blades of one of the standoff elements is arranged in a left-hand wrap orientation, wherein at least a portion of each of the blades of another of the standoff elements is arranged in a right-hand wrap orientation, and wherein said curvature of uphole standoff element blades has a left-hand orientation.

11. A rotating drill string sub according to claim 10, wherein said curvature of agitator blades has a right-hand orientation.

12. A rotating drill string sub according to claim 10, wherein said curvature of downhole standoff element blades has a right-hand orientation.

13. A rotating drill string sub to redistribute wellbore drill cuttings into the drilling fluid flowstream, having end couplings that affix said sub to other joints of said drill string and rotates with said drill string, comprising:

a drilling fluid agitator that is fixed to said sub, comprising:

a plurality of alternating blades having a curvature about the axis of said drill pipe, wherein each blade has a concave face looking toward the direction of rotation;

a plurality of alternating grooves, each groove located between a pair of adjacent said blades, and each comprising a flow channel that is open at both ends of said agitator;

a downhole standoff element that is fixed to said sub, having a plurality of alternating downhole standoff element blades, wherein each said blade comprises:

an abutment surface located at the outer diameter of each blade of said downhole standoff element all of said downhole standoff element blades having a curvature about said axis of sub; and a plurality of alternating grooves, wherein each said groove is located between two adjacent downhole standoff element blades, and having the same curvature about said axis of sub as said adjacent downhole standoff element blades, wherein the arrangement of said downhole standoff element blades and grooves about said axis of sub forms alternating helical flowpaths and alternating helical abutment surfaces;

an uphole standoff element that is fixed to said drill pipe, having a plurality of alternating uphole standoff element blades, wherein each said blade comprises:

an abutment surface located at the outer diameter of each blade of said uphole standoff element, all of said uphole standoff element blades having a curvature about said axis of sub;

a plurality of alternating grooves, wherein each said groove is located between two adjacent uphole standoff element blades, and having the same curvature about said axis of sub as said adjacent uphole standoff element blades, wherein the arrangement of said uphole standoff element blades and grooves about said axis of sub forms alternating helical flowpaths and alternating helical abutment surfaces, wherein at least a portion of each of the blades of one of the standoff elements is arranged in a left-hand wrap orientation, wherein at least a portion of each of the blades of another of the standoff elements is arranged in a right-hand wrap orientation, and wherein said curvature of uphole standoff element blades has a combination of right- and left-hand orientations, with the downhole end of each said blade having right-hand orientation and the uphole end of each said blade having left-hand orientation, said uphole and downhole ends of each blade being joined at a transition zone.

* * * * *